United States Patent [19]

Gierse et al.

[11] 4,065,837

[45] Jan. 3, 1978

[54] APPARATUS FOR CUTTING PILE FABRIC

[75] Inventors: Franz-Josef Gierse, Monchen-Gladbach; Carl-Christian Bastert, Korschenbroich; Wilhelm Busch, Monchen-Gladbach, all of Germany

[73] Assignee: Franz Müller, Monchen-Gladbach, Germany

[21] Appl. No.: 710,365

[22] Filed: Aug. 2, 1976

[30] Foreign Application Priority Data

Aug. 2, 1975 Germany ..... 2534674

[51] Int. Cl.[2] ..... D06C 13/08

[52] U.S. Cl. ..... 26/9; 26/10 R

[58] Field of Search ..... 26/8 R, 8 C, 9, 10 R, 26/10 C, 11, 12, 7; 139/291 C

[56] References Cited

U.S. PATENT DOCUMENTS

| | | | |
|---|---|---|---|
| 779,040 | 1/1905 | Hertzog | 26/10 C |
| 3,877,119 | 4/1975 | Gierse et al. | 26/9 |

FOREIGN PATENT DOCUMENTS

| | | | |
|---|---|---|---|
| 1,462 of | 1853 | United Kingdom | 26/11 |

*Primary Examiner*—Robert R. Mackey

*Attorney, Agent, or Firm*—Herbert L. Lerner

[57] ABSTRACT

A velvet cutting machine includes, a cutting knife having a knife holder, a knife blade and a velvet point, the velvet point extending at one end of the cutting knife in the form of a needle connected successively to the knife blade and the knife holder, the knife holder being connected by a shaft of the machine to a knife-retaining arm of the machine which, in turn, is coupled by another shaft of the machine, that is subjected to a spring, biasing force in peripheral direction thereof, to a cutting head of the machine swingingly suspended on a support arm of the machine extending substantially parallel to the region of a traveling fabric web that is to be cut. The velvet-point needle extends along a straight line at a side thereof facing toward the fabric web during travel of the latter in normal operation, and the cutting knife is formed with a recess extending over a region thereof located below the shaft connected to the knife holder on the side of the needle and terminating at a projection located at the opposite end of the cutting knife from that at which the needle is located, the projection having a side thereof facing toward the traveling fabric web that is disposed on an extension of the straight line along which the side of the needle extends.

5 Claims, 5 Drawing Figures

FFIG. 5

APPARATUS FOR CUTTING PILE FABRIC

The invention relates to a cutting knife of a velvet cutting machine. Such machines have a cutting head suspended from a support arm about the cutting region and swingable horizontally or parallel to the fabric web region that is to be cut. One end of a knife-retaining arm is pivotally mounted with the aid of a shaft in the cutting head. A spring-biasing force or load is applied to the knife-retaining arm in peripheral direction of the shaft. The cutting knife (also pivotable about a shaft) is articulatingly connected to the other end of the knife-retaining arm.

A velvet cutting knife can be considered to be formed of the following parts: firstly, of a so-called velvet point, which is an elongated plate bent into a U-formed shape, that terminates as a needle at one end thereof; secondly, of a knife retainer or holder with a shaft secured thereto which is pivotable in the knife-retaining arm; and thirdly, a knife blade which represents the cutting tool per se. The knife holder is clamped or soldered to the U-shaped plate at the end thereof opposite to the needle. The knife blade is clamped into the U-shaped plate. During operation, the cutting knife remains stationary while the fabric web is moved substantially parallel to the longitudinal extension of the U-shaped plate. Then the needle-shaped end of the cutting knife is introduced into the fabric loop that is to be cut. The latter runs onto the knife blade and is thereby cut open.

During the cutting of velvet, various types of cutting errors or faults may occur. For example, the cutting knife may travel upwardly out of the fabric loop that is to be cut. In this case, the harm or damage lies primarily in the lost operating time in order to seek out the location of the cut on the fabric web and to reintroduce the needle into the fabric loop. Especially heavy damage is caused by the emergence of the needle downwardly through the backing of the fabric web. The cutting can then cut such large holes and actually tear, if it is not withdrawn rapidly enough from the fabric web or the hole in the fabric web, so that not only part of the web may become worthless, but also cutting of the adjacent fabric loops may become more difficult.

In order to raise or withdraw the cutting knife from the fabric web as rapidly as possible, upon the occurrence of a cutting error or fault, releasable means are provided for retaining or holding the knife-retaining arm in cutting position as well as for monitoring the cutting pressure, and means for releasing the spring-biasing force or loading of the knife-retaining arm when the cutting pressure is too low or too high, such as spring-out of the cutting knife from the fabric loop to be cut or insertion thereof into the backing of the fabric web. By such means, as are, for example, described in German Published Non-Prosecuted Application No. DT-OS 2,226,053, the cutting knife is swung outwardly and thereby raised from the fabric web or withdrawn out of the latter, upon the occurrence of a cutting error or fault in travel direction of the fabric (due to the effect of the spring-biasing force or loading).

The means releasing the spring-biasing force or loading may be released, however, initially with pressure markedly deviating from conventional cutting pressure, with the foregoing effect, because otherwise, for every small deviation of the cutting pressure, for example due to dissimilarity of the thickness of the threads to be cut, the knife would be raised. If the cutting knife or the needle end thereof then protrudes downwardly through the backing of the fabric web, a given period of time thus passes until the pressure acting upon the cutting knife becomes large enough for releasing the spring-biasing force or loading. One is inclined, therefore, to permit the cutting knife, when the needle protrudes through the backing of the fabric web, to swing or pivot downwardly about the shaft with which the knife is articulatingly connected at the knife-retaining arm. This has the advantage, on the one hand, that the shoulder of the knife retainer or holder facing in the direction of movement of the fabric web, is displaced or shifted somewhat in travel direction thereof and, on the other hand, due to the swinging or pivoting of the cutting knife, means for releasing the spring-biasing force or loading of the knife-retaining arm are actuable.

When the needle protrudes downwardly, the fabric web or the hole in the fabric runs onto the shoulder of the knife retainer or holder (behind the knife blade) which faces in the travel direction of the fabric web. The backing of the fabric web can thereby not only be cut into but also torn and, in fact, under conditions far above or beyond the region of the fabric loop which is actually to be cut. Naturally, this danger must be reduced to a minimum. With increasing fabric speed, the danger of the occurrence of damage and the amount of damage increases in the aforementioned sense. The damage or the danger of occurrence of damage becomes greater, the longer it takes for the cutting knife amongst others to swing or pivot about the shaft at the knife-retaining arm. With the heretofore known or conventional construction of a cutting knife, this swinging or pivoting of the cutting knife occurs, at the latest when (upon the projection of the needle downwardly) the fabric-web hole has slid on the cutting knife up to the aforementioned shaft i.e. over and beyond the knife blade and onto the shoulder of the knife retainer or holder facing in direction of travel of the fabric web. For the most part, the damage caused is by then already quite considerable.

If, for example, the distance of the shoulder of the knife retainer or holder facing in travel direction of the fabric web to the shaft (pivot point) thereof is 4 cm and the fabric-web speed is 200 m/min, the time period from the run-up of the fabric web onto the shoulder until the fabric-web hole has reached the pivot point of the knife retainer or holder is calculated as the quotient of 4 cm and 200 m/min, which is 12 milliseconds. With conventional mechanisms of the foregoing type, the cutting knife, at the particular or indicated maximum speed of 200 m/min is swung or pivoted mostly opportunely before lapse of these few milliseconds and is withdrawn out of the fabric.

During the increase in the operating speed of velvet cutting machines which is striven for in the course or train of rationalization, one encounters limitations because of the extraordinarily short time period for swing or pivoting and withdrawing the cutting knife out of the web, because one cannot put up with the aforementioned damage caused by the penetration or projection of the needle. Since other parts of velvet cutting machines, however, by all means, permit considerable increases in the operating speed, for example, to 500 m/min. (note German Published Non-Prosecuted Application Nos. DT-OS 2,226,052, 2,226,053 and 2,256,638 as well as German Petty Pat. No. DT-GM 7,220,046), the general object of the invention of the instant application is to provide a cutting knife which is pivotable or swingable with the shaft thereof (in the knife-retaining arm), especially when the needle penetrates and projects through the backing of the fabric web, at a speed that is increased so that the operating speed can be raised to at least 400 m/min (instead of the heretofore conventional maximal 200 m/min).

With the foregoing and other objects in view, namely the special object of providing a cutting knife wherein the resistance opposing the swinging or pivoting movement of the cutting knife, which originates from the cutting knife per se, is eliminated or at least considerably minimized, there is provided in accordande with the invention in a velvet cutting machine, a cutting knife having a knife holder, a knife blade and a velvet point, the velvet point extending at one end of the cutting knife in the form of a needle connected successively to the knife blade and the knife holder, the knife holder being connected by a shaft of the machine to a knife-retaining arm of the machine which, in turn, is coupled by another shaft of the machine, that is subjected to a spring-biasing force in peripheral direction thereof, to a cutting head of the machine swingingly suspended on a support arm of the machine extending substantially parallel to the region of a traveling fabric web that is to be cut.

Other features which are considered as characteristic for the invention are set forth in the appended claims.

Although the invention is illustrated and described herein as embodied in a cutting knife in a velvet cutting machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of a specific embodiment when read in connection with the accompanying drawings, in which.

Figure 1:
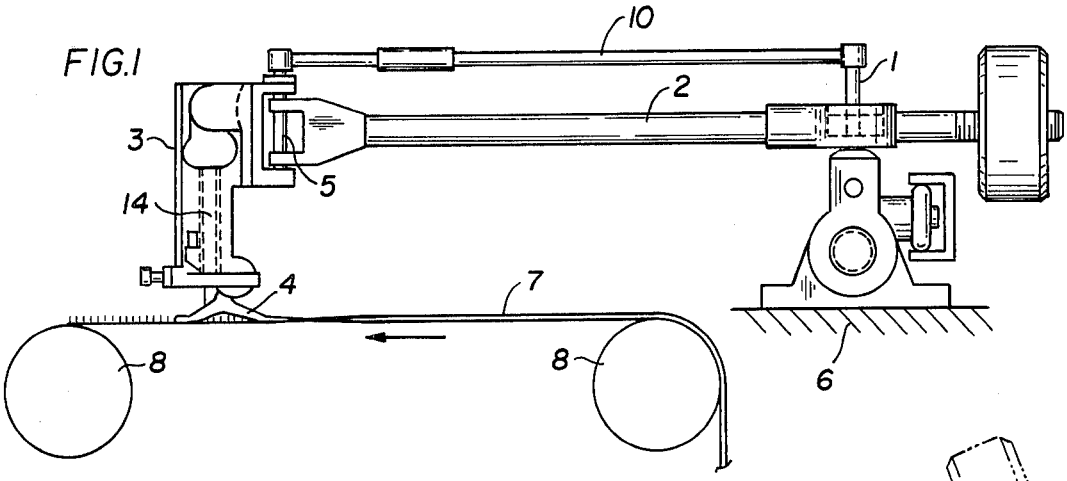
FIG. 1 is a diagrammatic elevational view, partly in section, of a velvet cutting machine incorporating the cutting knife of the invention.
Figure 2:
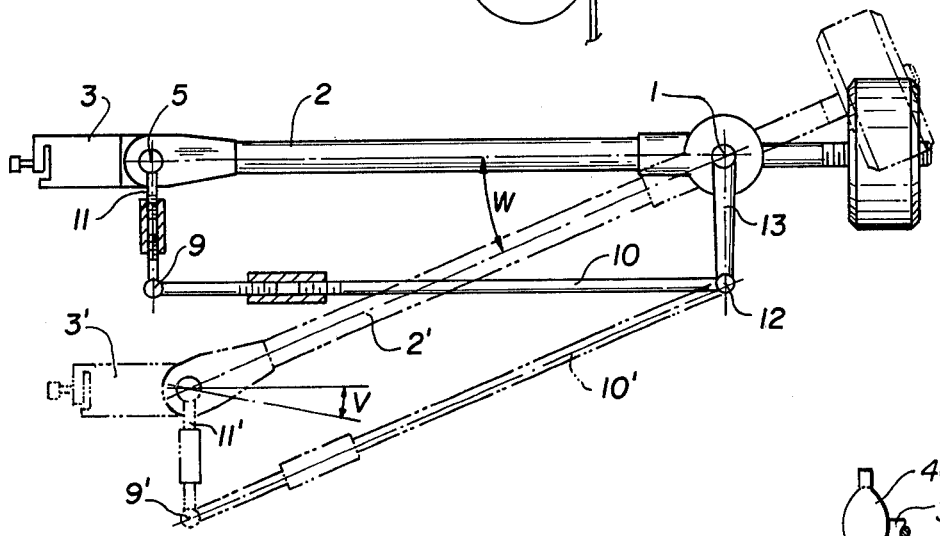
FIG. 2 is a top plan view of FIG. 1.
Figure 2:
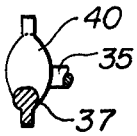

Referring now to the drawings and first, particularly, to FIGS. 1 and 2 thereof, there is shown therein a cutting or support arm 2 pivotable about a shaft 1 located at one end thereof. A cutting head 3 provided with a cutting knife 4 according to the invention is mounted for pivotal movement about a shaft 5 at the other end of the arm 2 located opposite the end at which the shaft 1 is located. The pivotal movement is performed in a manner shown and described in U.S. Pat. No. 3,877,119 issued Apr. 15, 1975. The shaft 1 is connected to a diagrammatically illustrated machine frame 6. A fabric web 7 travels in the direction of the associated arrow over rollers 8 below the cutting knife 4 in such manner that the cutting knife 4 respectively cuts open a fabric loop.

In the illustrated embodiment of FIGS. 1 and 2, the construction of the cutting knife 4 is purported, due to the use of a four-linkage joint or articulation transmission, to be adjustable by the joint transmission automatically parallel to the longitudinal direction of the fabric loops to be severed. In FIGS. 1 and 2, a double swing or pivot is provided wherein the support arm 2 is firmly connected to the shaft or bearing 5 on which the cutting head 3 is pivotally mounted and wherein the cutting head 3 is connected to a pivot bearing 12 through two rods 10 and 11 with the aid of an articulating joint or hinge 9, the pivot bearing 12 having an axis parallel to that of the shaft 1 and, as in the case of the latter, being connected to an arm 13 forming part of the machine frame 6. The rod 11 accordingly forms the couple, and the part of the machine frame 6 between the shafts 1 and 12, is the arm 13 of the double swing or pivot. As is to be expected with such a construction, when the support arm 2 is deflected about the angle W, the cutting head 3 and, accordingly, the cutting knife 4 connected to the cutting head 3 by a knife-retaining arm 14 is shifted virtually or substantially parallel to itself (deviating from parallelism by the angle V). Such a deflected position or setting is illustrated by the broken lines in FIG. 2; corresponding features in the setting represented by the broken lines are identified with the same reference numeral followed by a prime.

The embodiment shown in FIGS. 1 and 2 has an advantage over corresponding prior-art devices in that the cutting knife 4, at each lateral deflection, is additionally pivoted so that the needle-like extension thereof always extends in the direction of the respective fabric loop that is to be cut open. The support arm 2 of the device according to FIGS. 1 and 2 is relatively short compared to other heretofore known support arms having a rigid fastening of the cutting head. The moment of inertia is thereby accordingly reduced. The illustrated embodiment of FIGS. 1 and 2 is therefore especially suited for velvet cutting machines with fabric speeds of about 200 to 500 meters per minute and more.

Figure 3:
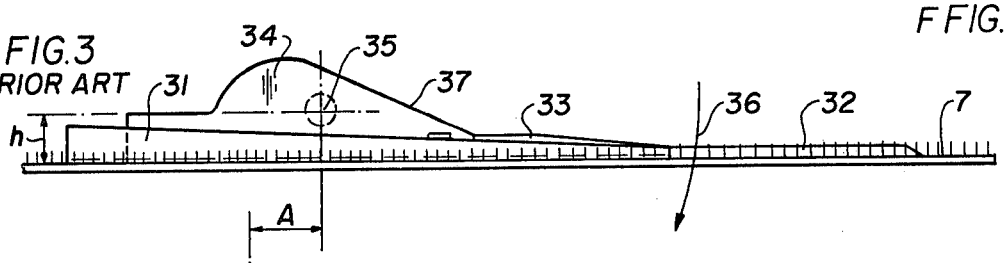
FIG.3 PRIOR ART
FIG. 3 is an elevational view of a conventional cutting knife shown in position diagrammatically on a length of velvet fabric.

FIG. 3 shows a cutting knife of conventional construction. It is formed with a so-called velvet point 31, which is usually a plate bent into a U-shape and having at an end 32 thereof a needle-like point. A knife-blade 33 and a knife holder 34 are furthermore clamped or soldered or secured in any other suitable manner in the U-shaped bent plate. The knife holder 34 has a pivot point 35 in which the knife holder 34, with the aid of a shaft, is pivotally connected to the knife retaining arm 14 (note FIG. 1) of the cutting head 3. The knife holder 34 and, thereby, the entire cutting knife are thus pivotable about the pivot point 35 in the direction of the arrow 36. Details of the holding and deflecting means of the cutting head, that are otherwise of no interest with respect to the invention of the instant application, are described in and may be obtained from German Published Non-Prosecuted Application No. DOS 2,226,053.

The conventional cutting knife of FIG. 3 is flat or planar on the side thereof facing toward the fabric web 7, and the velvet point 31 accordingly forms a straight line on this side. When the needle point 32 is stuck into the base of the fabric web, the cutting knife cannot readily be swung around downwardly in the direction of the arrow 36, as viewed in FIG. 3, because the underside, per se, thereof exerts a corresponding backing or coercive force on the cutting knife. Swinging around is possible rather only if the hole in the fabric web has reached the vicinity of the pivot point 35 and, therefore, the resistance against the swinging around originating from the underside of the cutting knife ceases. During cutting or severing, the fabric web is already tightly stressed in itself. If the point of the knife and, in fact, the shoulder 37 of the knife holder, in further course of the operation, are driven into the fabric-web hole, the tension or stress in the fabric web continues to increase in vicinity of the cutting knife. Before the fabric-web hole has reached the pivot point 35, the fabric web, per se, thus presses the cutting knife from above and below with virtually the same force, so that swinging of the knife does not occur at all, initially. The swinging begins only if the force opposing the swinging from the underside of the cutting knife ceases. This is the case when the fabric-web hole reaches the pivot point 35. As is apparent, a markedly large hole has, however, by then been cut or torn in the fabric web or the backing thereof.

Figure 4:
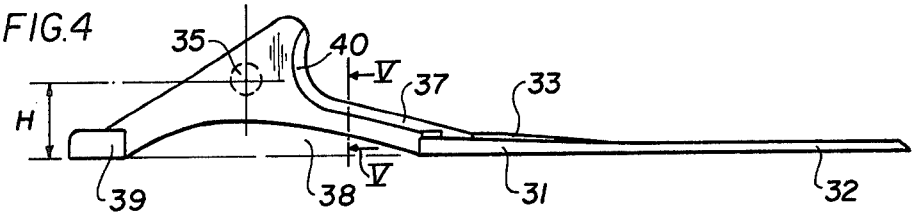
FIG. 4 is an enlarged fragmentary view of FIG. 1 showing the cutting knife of the invention in detail.

An embodiment of the cutting knife of the invention is shown in FIG. 4. The cutting knife of the invention is formed with a recess 38 on the underside thereof facing the fabric web, as shown in FIG. 4. The recess 38 begins at a location in front of the pivot point 35 and extends beyond the latter to a projection 39, the underside of which is disposed on the same straight line as is the underside of the needle 31.

If the needle point 32 of the cutting knife of the invention shown in FIG. 4 passes through the backing of the fabric web that is to be severed, the pierced hole runs further on the needle until it reaches the knife blade 33. In the latter region, the underside of the pierced fabric web can effect no appreciable resistance any longer against swinging around of the cutting knife because the latter offers no gripping surface any longer from the region of the knife blade 33 up to the pivot point 35 for the coercive or backing force acting from the fabric web. The cutting knife according to the invention will swing around at a much earlier point in time than the heretofore known cutting knives.

Moreover, the part of the cutting knife below the shoulder 37 has a much smaller width or thickness than the conventional cutting knife, as is readily apparent from a comparison of FIGS. 3 and 4, for example. If the shoulder 37 should actually penetrate into the hole of the pierced fabric web, it will not punch out holes as large as heretofore produced by the conventional cutting knives with thicker shoulders 37. Furthermore, the shoulder 37 has a reinforcement or thickened portion 40 on the side thereof facing in the travel direction of the fabric web, which ensures that the surface with which the fabric web presses against the shoulder is considerably increased as compared to the case for the conventional cutting knife. The force exerted upon the cutting knife, which tends to effect a swinging-around of the latter, is thus also increased.

The combination of reinforced shoulder 37, 40 and recess 38 has an unexpected advantageous effect. Because the (inertial) mass added by reinforcement of the shoulder was already overcompensated by the mass removed from the recess 38, the moment of inertia corresponding to the pivot point 35 is always smaller yet than that to which one was accustomed for heretofore known, conventional cutting knives.

As is apparent from FIG. 4, the pivot point 35 in the cutting knife of the invention, is located a distance H above the line on which the cutting knife lies on the fabric web. As is clear from a comparison with the conventional cutting knife of FIG. 3, the corresponding distance *h* is much smaller than the distance H. In comparing specific examples, it was found that the ratio *H:h* = 12 mm:8 mm. Furthermore, the pivot point 35 of the cutting knife of the invention has been shifted somewhat to the rear away from the needle point 32 (note the distance A). Due to the fact that the pivot point 35 has been shifted so that it is higher above the fabric web and has been shifted further to the rear within the cutting knife, the forces acting to swing the cutting knife around are applied at greater lever arms than those previously possible with conventional cutting knives.

We claim:

1. A cutting arm device for a cutting machine for cutting the individual loops of a weft pile fabric such as velvet, corduroy, or the like comprising a frame, a cutting arm having an end thereof pivotally mounted on said frame for pivotal movement about a first axis, a cutting head pivotally mounted on the other end of said cutting arm for pivotal movement about a second axis, said cutting head carrying a cutting knife for cutting the pile loops of a web of material passing underneath said cutting head, said first and second pivotal axes being disposed generally parallel to one another, and actuating means operatively connected between said first and second pivot axes providing for pivotal movement of said cutting head relative to said cutting arm about said second axis as said cutting arm is pivoted on the frame about said first axis, said cutting arm being pivotable in a plane substantially parallel to the plane of said web of material passing underneath said cutting arm, said cutting knife having a knife holder, a knife blade and a velvet point, said velvet point extending at one end of the cutting knife in the form of a needle connected successively to said knife blade and said knife holder, a knife-retaining arm, a shaft connecting said knife holder to said knife-retaining arm, another shaft, subjectible to a spring-biasing force in peripheral direction thereof, coupling said knife-retaining arm to said cutting head, said velvetpoint needle extending along a straight line at a side thereof facing toward a fabric web during travel of the latter in normal operation, said cutting knife being formed with a recess extending over a region thereof located below said shaft connected to said knife holder on said side of said needle and terminating at a projection located at the opposite end of said cutting knife from that at which said needle is located, said projection having a side thereof facing toward the traveling fabric web, said side of said projection being disposed on an extension of said straight line along which said side of said needle extends.

2. Cutting knife according to claim 1 wherein said knife-holder is formed with a shoulder connected to said knife blade and facing toward said needle, said shoulder being beadlike reinforced opposite the underside thereof which faces toward the fabric web during said travel thereof.

3. Cutting knife according to claim 2 wherein said shaft connected to said knife holder is located at a predetermined maximal distance behind said shoulder of said knife holder facing toward said needle so as to maximize the force component which acts upon said knife holder during penetration of said needle through the backing of the fabric web and which effects pivoting of the knife holder about said shaft connected to said knife holder without increasing the moment of inertia with respect to said shaft connected to said knife holder.

4. Cutting knife according to claim 2 wherein said shaft connected to said knife holder is located at a predetermined maximal distance from the surface of the fabric web traveling along a given path and is located at a predetermined maximal distance behind said shoulder of said knife holder facing toward said needle so as to maximize the force component which acts upon said knife holder during penetration of said needle through the backing of the fabric web and which effects pivoting of said knife holder about said shaft connected to said knife holder without increasing the moment of inertia with respect to said shaft connected to said knife holder.

5. Cutting knife according to claim 1 wherein said shaft connected to said knife holder is located at a predetermined maximal distance from the surface of the fabric web traveling along a given path so as to maximize the force component which acts upon said knife holder during penetration of said needle through the backing of the fabric web and which effects pivoting of said knife holder about said shaft connected to said knife holder without increasing the moment of inertia with respect to said shaft connected to said knife holder.

* * * * *